United States Patent [19]

Scharboneau

[11] Patent Number: 4,561,271

[45] Date of Patent: Dec. 31, 1985

[54] LOCK BYPASSING TOOL

[75] Inventor: Gerald L. Scharboneau, Trenton, Mich.

[73] Assignee: Jack Van Wallaghen, Trenton, Mich. ; a part interest

[21] Appl. No.: 562,422

[22] Filed: Dec. 19, 1983

[51] Int. Cl.[4] ..... E05B 19/12

[52] U.S. Cl. ..... 70/399; 70/409; 81/488

[58] Field of Search ..... 70/393–396, 70/399, 409; 81/488; 33/174 F

[56] References Cited

U.S. PATENT DOCUMENTS

| | | | |
|---|---|---|---|
| 34,460 | 2/1862 | Bennett . | |
| 384,592 | 6/1888 | Ross | 70/396 |
| 711,889 | 10/1902 | Wormald . | |
| 1,191,127 | 7/1916 | Rosenshine | 70/396 |
| 1,221,703 | 4/1917 | Dubé | 70/399 |
| 1,337,085 | 4/1920 | Malys | 70/399 |
| 1,426,468 | 8/1922 | Esson | 70/395 |
| 1,446,760 | 2/1923 | Miller | 70/395 |
| 2,035,798 | 6/1934 | Denull . | |
| 4,338,863 | 7/1982 | Block . | |

FOREIGN PATENT DOCUMENTS

| | | | |
|---|---|---|---|
| 402059 | 9/1909 | Austria | 70/399 |
| 334389 | 3/1921 | Fed. Rep. of Germany | 70/409 |
| 393824 | 4/1924 | Fed. Rep. of Germany | 70/399 |
| 656789 | 1/1929 | France | 70/399 |
| 2393903 | 6/1977 | France . | |

*Primary Examiner*—Gary L. Smith
*Assistant Examiner*—Lloyd A. Gall
*Attorney, Agent, or Firm*—Hauke and Patalidis

[57] ABSTRACT

A tool for operating the bolt mechanism of a cylinder lock without the use of a key. The tool comprises a slender steel rod provided on its end with at least one hingedly pivotable knuckle member or portion constantly urged by spring bias means to a pivoted position at a right angle to the axis of the shank. The tool is inserted through the plug key slot until the jointed knuckle member or portion projects beyond the end of the key slot and is automatically extended to a 90°-angle such as to operate the bolt mechanism in the same manner as the conventional lock cam.

19 Claims, 9 Drawing Figures

LOCK BYPASSING TOOL

BACKGROUND OF THE INVENTION

The present invention relates to a lock bypassing tool for operating, for example, the deadbolt of a mortise-cylinder lock without using the key designed for fitting the lock.

Opening locked doors by means other than the key designed for a particular lock is a service rendered frequently by licensed and bonded locksmiths when hired by the occupants of locked premises having lost or misplaced their key, or when called upon to open locked premises for the benefit of appropriate public safety officials having legitimate reasons for gaining access to the locked premises.

The apparition on the market of high security locking systems have caused conventional lock "picks" to become obsolete, and has given rise to a new generation of specialized unlocking tools, such as vibrating blade or movable rod tools, in attempts to provide alignment of the lock tumbler pins with the shear line between the lock plug and cylinder such as to enable the plug to be rotated relative to the cylinder. Because most security locks have portions made of case hardened steel, drilling out the lock, even with a masonry drill bit may be difficult, and always results in causing considerable, and often irrepairable damages to the lock, or even to the door, thus requiring replacement of the lock and repair of the damages.

In U.S. Pat. No. 4,339,863, there is disclosed a lock opening tool capable of operating the deadbolt of a mortise-type cylinder lock, after drilling out the plug to the relatively large diameter of the tool such as to permit insertion of the tool shank through the drilled out plug. The tool consists of a flexible steel blade disposed in an elongated tubular housing open at one end and closed at the other end where it is provided with a radial slot through which the end of the flexible blade projects at a 90°-angle for engagement with the latch or bolt operating bolt operating mechanism. Such a lock opening tool requires that a relatively large bore be drilled through the plug of the lock, and considerable difficulty may be encountered in attempting to operate the bolt with a length of relatively thin flexible steel blade.

SUMMARY OF THE INVENTION

The present invention provides a relatively simple and inexpensive tool that permits operation of a latching means, such as a deadbolt for example, without unlocking the lock associated with the latching means, and by actually bypassing the locked lock. The tool of the present invention has particular usefulness with high security locks and mortise cylinder locks. When used with certain types of locks having a relatively wide key slot portion, usually at the bottom of the key slot, the tool of the invention does not require drilling of the plug for widening the key slot, and for other types of locks operated by a relatively slender key, the tool of the invention requires only a slight localized enlargement of the key slot by drilling, such as to permit introduction of the tool through the enlarged key slot until the end of the tool protrudes beyond the plug and automatically projects at a right angle to the axis of the tool shank with the capability of reaching to an appropriate distance for engaging the bolt withdrawal mechanism.

The present invention accomplishes its objects by way of a tool having a relatively slender shank and provided at its active, or working, end with at least one, and preferably two, three or more, hinged and spring-biased portions adapted to automatically project at a right angle to the axis of the shank the appropriate distance required for functioning in the same manner as the bolt-operating cam associated with the lock plug.

The diverse objects and advantages of the present invention will become apparent to those skilled in the art when the following description of the best mode contemplated for practicing the invention is read in conjunction with the accompanying drawing, given for illustrative purpose only, and wherein:

DETAILED DESCRIPTION OF THE PREFERRED EMBODIMENT

Figure 1:
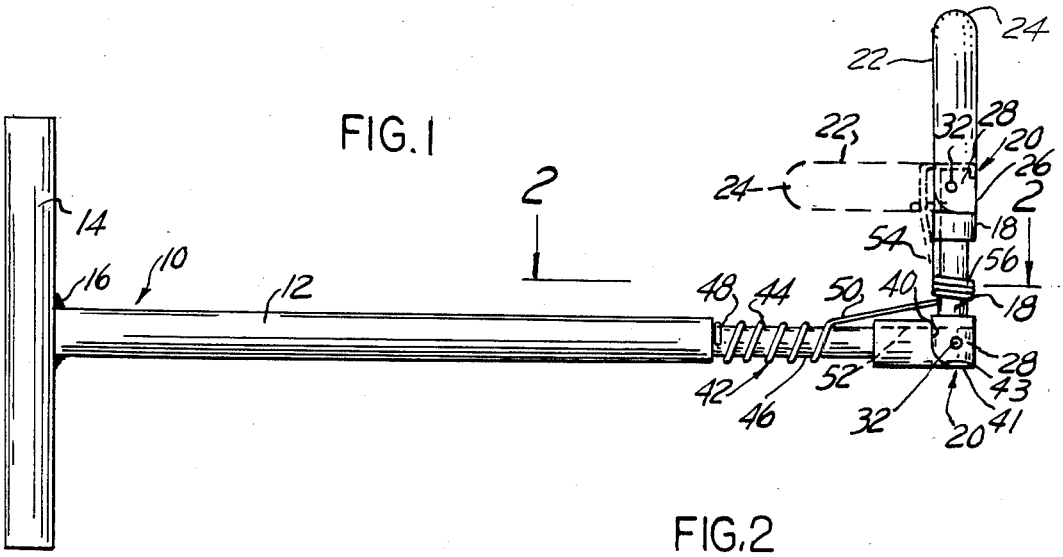
FIG. 1 is an elevation view of an example of structure for a lock bypassing tool according to the present invention shown in its normal relaxed shape prior to introduction through a plug slot.
Figure 2:
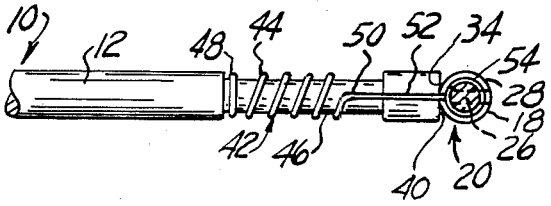
FIG. 2 is a partial view from line 2—2 of FIG. 1.
Figure 3:
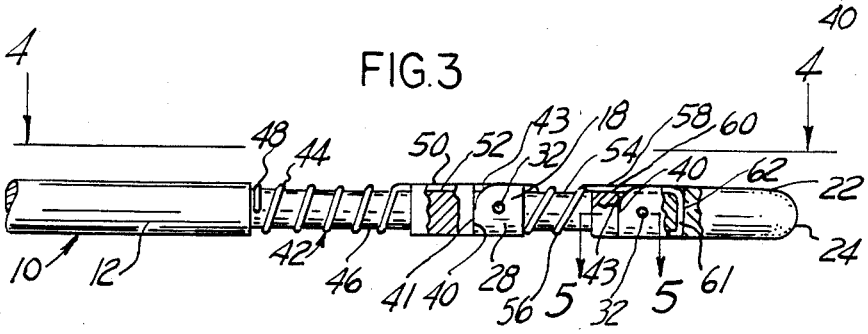
FIG. 3 is a partial view similar to FIG. 1 with portions broken away, showing the tool of the invention fully extended during introduction through the key slot in the plug of a lock.

Referring to the drawing, and more particularly to FIGS. 1–4, an example of structure for a lock bypassing tool 10 according to the present invention takes the form of a relatively slender steel rod forming a shank 12 provided at one end with a T-handle 14 attached thereto by any convenient means, such as welding or brazing, as shown at 16. A first jointed knuckle portion 18 is hingedly mounted, as shown at 20, at the end of the shank 12 and a second jointed knuckle portion 22 is hingedly mounted by an identical hinge structure 20 at the end of the first jointed knuckle portion 18. Although two jointedly hinged knuckle portions 18 and 22 are illustrated, it will be appreciated that the tool 10 may be provided with a single hinged knuckle portion, or with more than two. Preferably, the terminal knuckle portion, such as jointed knuckle portion 22, is provided with a smoothly rounded, or hemispherical, tip 24.

Figure 4:
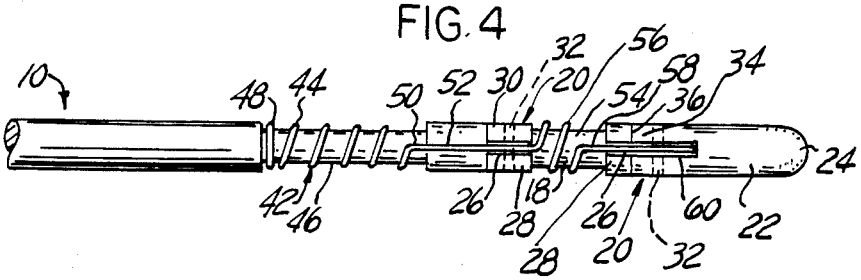
FIG. 4 is a partial elevation view thereof from line 4—4 of FIG. 3.
Figure 5:
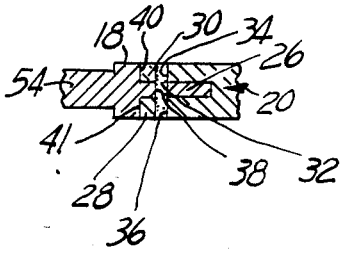
FIG. 5 is a section through 5—5 of FIG. 3.

Each hinge structure 20 comprises a tongue portion 26, as best shown at FIGS. 4 and 5, formed integral at one end of the shank 12 or of the jointed knuckle portion 18, respectively, the corresponding opposite end of the jointed knuckle portion 18 or 20, respectively, being bifurcated such as to form a pair of parallel segments 28 and 30 accepting therebetween the projecting tongue 26. A pin 32 is disposed through aligned transverse bores 34, 36 and 38, FIG. 5, in both the bifurcated segments 28 and 30 and the tongue 26. The pin 32 has a press-fit in the bores 34 and 36 in the bifurcated portions 28 and 30 and a relatively free-fit in the bore 38 in the tongue 26, for example, such as to permit the jointed knuckle portion 18 to pivot to substantially 90° from the axis of the shank 12, and the jointed knuckle portion 22 to pivot, in the same plane, substantially 90° from the longitudinal axis of the jointed knuckle portion 18. The hinge structures 20 limit such pivoting to substantially 90° in view of the peripheral surface of the bifurcated portions 28 and 30 engaging the end face 40 of, respectively, the shank 12 and the jointed knuckle portion 18 when the 90° position of the jointed knuckle portions 18 and 22 is achieved. The jointed knuckle portion 18 or 20 is prevented from pivoting in an opposite direction by providing the terminal edge of the bifurcated segments 28 and 30 with a flat surface portion 41 engageable in abutment with the end face 40 of the shank 12, or of the jointed knuckle portion 18, when the corresponding jointed knuckle portion is pivoted so that its axis is aligned with the axis of the shank 12 or of the jointed knuckle portion 18, respectively. Pivoting in the appropriate direction is allowed by a radiused surface 43 extending over an arc of approximately 45° formed on the end face of the bifurcated portions 28 and 30. The orientation of the hinge structures 20 is such that the pivoting of all the jointed knuckle portions is effected substantially in a common plane.

The jointed knuckle portions 18 and 22 are constantly urged to their right angle position illustrated at FIG. 1 by appropriate biasing means such as a spring 42. The spring 42, made of highly flexible and resilient spring wire such as very slender piano wire, shown in grossly exaggerated size for the sake of clarity, has a coil portion 44 of a few spirals disposed around a reduced diameter section 46 of the shank 12. The end 48 of the spring coil portion 44 is attached to the surface of the shank reduced diameter portion 46 by soldering or brazing, for example. The other end of the spring coil portion 44 has a straight portion 50 which, preferably, is passed through a longitudinal groove 52 formed in the end of the shank 12, including the tongue 26, such as to extend over a reduced diameter portion 54 of the jointed knuckle portion 18 around which the wire of the spring 42 is once again wound as a coil 56 of a few spirals. The end of the spring wire coil portion 56 comprises a straight portion 58 passed through an appropriate longitudinal groove 60 and is attached to, at its end, to the jointed knuckle portion 22 beyond the pivot axis of its hinge 20 by being provided, for example as shown, by a bent-over portion 61 (FIG. 3) passed through an appropriate transverse bore 62 through the jointed knuckle portion 22. The biasing action of the spring 42 is such that the end knuckle portion 22 is urged from a position axially aligned with the knuckle portion 18 as shown in full line at FIG. 1 to a position wherein the end knuckle portion 22 is pivoted to a 90° position relative to the jointed knuckle portion 18, as shown in phantom line.

The undercut reduced diameter portion 46 of the shank 12 and 54 of the jointed knuckle portion 18, and the longitudinal grooves 52 and 60 are not necessary for the proper functioning of the tool 10 o the invention, but such a structure is desirable for achieving a tool as slender as possible when the jointed knuckle portion 18 and 22 are disposed in axial alignment with the shank 12, preparatory to use, to permit introduction through a key slot in a lock plug without necessitating drilling of the plug, if the key slot is wide enough, or requiring only a slight widening of the key slot by drilling. Typically, a set of three tools according to the present invention, the slenderest made of steel rod of about 0.090 inch (2.3 mm) diameter, the medium size being made of 0.123 inch (3.1 mm) diameter steel rod and the larger size being made of about 0.185 inch (4.7 mm) diameter steel rod, is sufficient to accommodate the majority of mortise-type locks and mortise-type high security locks.

Figure 6:
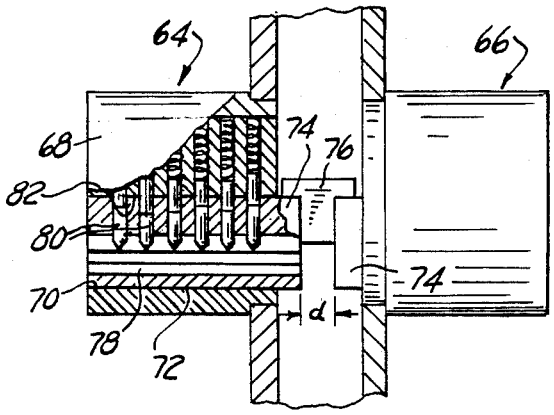
FIGS. 6–9 are schematic views of a double cylinder deadbolt lock set useful in explaining the operation of a tool according to the invention.

FIG. 6 schematically illustrates a double cylinder deadbolt lock set comprising a pair of locks 64 and 66 installed, for example, on the outside and on the inside of a door, not shown. As is well known in the art, each lock comprises a barrel or cylinder 68 having a bore 70 in which is rotatably disposed a plug 72. One end of the plug 72 is provided with a cam 74 adapted to operate the latch mechanism 76 of, for example, a deadbolt, when the plug 72 is rotated. A configured key slot 78 extends longitudinally through the center of the plug 72, and when a key of the appropriate shape is introduced into the key slot 78, the tumbler pins 80 are lifted to their shear line 82 thus permitting the plug 72 to rotate relative to the cylinder 68. It will be readily appreciated that the space between the end faces of the cylinder locks 64 and 66 is relatively narrow, more particularly the space d between the cams 74. One particular advantage of the tool 10 of the invention is its ability to operate the latch mechanism 76 by having the length of each of the jointed knuckle portions 22 and 18 be slightly less than the distance or space d separating the cams 74 in a double cylinder lock set. In most double cylinder lock sets presently available on the market, the distance or space d, FIGS. 6–9, between opposite cams 74 is generally of the order of a quarter of an inch or more, which determines the preferred length for each of the jointed knuckle portions 22 and 18 to be preferably slightly less than a quarter of an inch long (about 6 mm long).

When a locksmith is confronted with the task of opening a pin-tumbler lock that cannot be opened by picking or other techniques, drilling along the shear line 82, FIG. 6, is usually the last resort technique left to him. Drilling along the shear line cuts off the pins 80 and permits rotation of the plug 72 relative to the cylinder 68. However, such technique destroys the lock, and if the depth of drilling is not carefully controlled, the cam may be cut off, as a result of drilling through a slender portion of the cam body, or the cam may be weakened to the point that it breaks off when an attempt is made to operate the bolt mechanism by rotating the plug and cam. In addition, high security locks are often provided with hardened armor steel protective rods and shields disposed along the shear line in the cylinder and/or the plug, which make drilling of the lock a very difficult task.

The jointed tool 10 of the present invention requires no drilling for certain types of locks having a relatively wide key slot, and very little drilling for most types of locks, the drilling being effected through the key slot to a size sufficient only to permit the introduction of the tool through the key slot. The drilling being effected through the key slot, the drill bit does not encounter hardened steel rods or shields, and leaves the cam intact.

Figure 7:
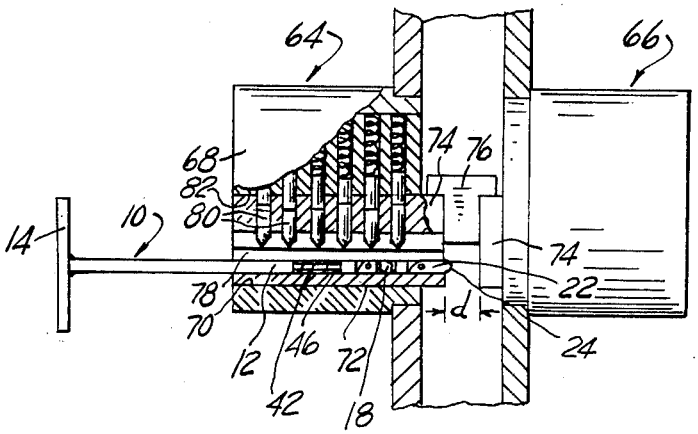
Figure 8:
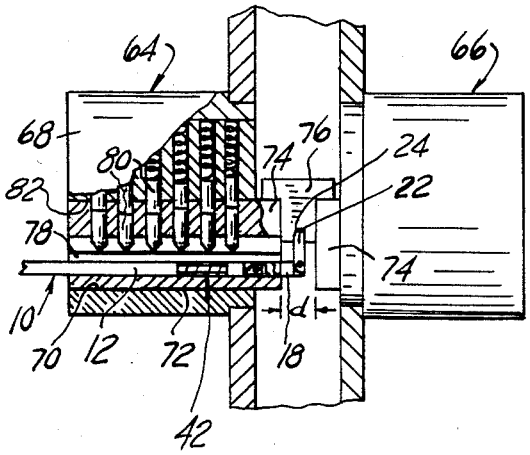
Figure 9:
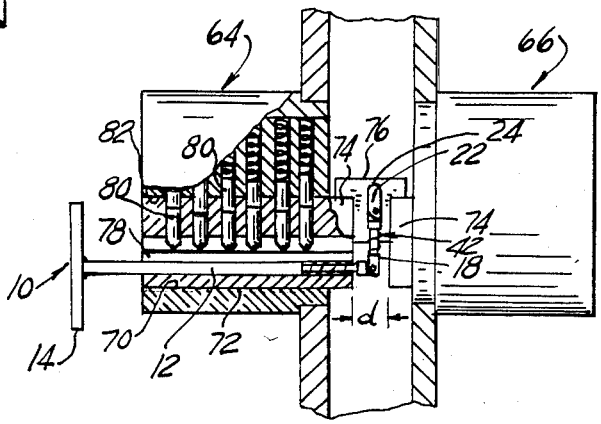

As shown at FIG. 7, the tool 10 is introduced through the key slot 78 with the jointed knuckle portions 22 and 18, in the example of structure illustrated, aligned with the shank 12. The rounded tip 24 of the end jointed knuckle portion 22 facilitates sliding through the key slot 78 in spite of the pull exerted by the spring 42 urging the jointed knuckle portions towards their hinged over angular position. When the tool 10 is pushed far enough through the key slot 78, and as soon as the full length of the end jointed knuckle portion 22 projects beyond the back end of the key slot (FIG. 8), the tension spring 42 automatically causes the jointed knuckle portion 22 to pivot to a right angle position relative to the axis of the tool. In structures where the reach of the end jointed knuckle portion 22 is sufficient to operate the latch or deadbolt mechanism 76, rotation of the tool 10 in an appropriate direction by means of the T-handle 14 operates the latch or deadbolt to its retracted position, in the same manner as if it were operated by one of the cams 74. If the reach is insufficient, further pushing the tool 10 through the key slot 78 enables the right angle projecting portion of the tool, now consisting of the jointed knuckle portion 18 and aligned jointed knuckle portion 22 (FIG. 9), to operate the latch or bolt mechanism 76.

It will be readily apparent to those skilled in the art that the scope of the present invention encompasses hinge structures other than the specific hinge structure herein disclosed and illustrated in detail, and other means for applying an appropriate bias load for automatically pivoting the tool jointed knuckle portions, other than spring wire herein described and illustrated will come to the mind of those skilled in the art. Having thus described the present invention by way of an example of structure well designed to accomplish the objects of the invention, modification whereof will be apparent to those skilled in the art, what is claimed as new is as follows:

I claim:

1. A tool for operating the bolt mechanism of a cylinder type lock, said lock being provided with a plug having a key slot, said tool comprising an elongated relatively slender metallic rod forming a shank, a jointed knuckle portion hingedly mounted at an end of said shank by hinge means allowing approximate 90° pivoting of said jointed knuckle portion from a position aligned with said shank to a position substantially at a right angle to said shank, abutment means preventing pivoting of said jointed knuckle portion in an opposite direction, and biasing means constantly urging said jointed knuckle portion to said right angle pivoted position wherein said biasing means comprises a spring wire having an end attached to said shank and a coil portion disposed around said shank provided with another end attached to said jointed knuckle portion, said other end of said spring wire attached to said jointed knuckle portion comprising a coil portion disposed around said jointed knuckle portion and an integral straight portion disposed between said coil portions.

2. The tool of claim 1 further comprising a T-handle fastened at the other end of said shank.

3. The tool of claim 1 comprising a plurality of said jointed knuckle portions, wherein all of said jointed knuckle portions are hingedly pivotable substantially in a common single plane.

4. The tool of claim 1 wherein said hinge means comprises a tongue projecting axially from said end of said shank, a bifurcated end portion at a corresponding end of said jointed knuckle portion, said bifurcated end portion straddling said projecting tongue, a pivot member disposed through aligned transverse bores in said tongue and said bifurcated end portion.

5. The tool of claim 4 wherein said pivot member is a pin.

6. The tool of claim 1 wherein said other end of said spring wire attached to said jointed knuckle portion comprises an integral straight portion having an end portion bent over and engaged in a transverse bore in said jointed knuckle portion.

7. The tool of claim 6 wherein said spring wire straight portion is disposed in a longitudinal surface groove when said knuckle portion is axially substantially aligned with said shank.

8. The tool of claim 1 wherein said shank has a reduced diameter portion around which said spring wire coil portion is disposed.

9. The tool of claim 8 wherein said spring wire straight portion is disposed in a longitudinal surface groove when said knuckle portion is axially substantially aligned with said shank.

10. The tool of claim 1 wherein said knuckle portion has a reduced diameter portion around which said spring wire coil portion is disposed.

11. The tool of claim 1 wherein said spring wire straight portion is disposed in a longitudinal surface groove when said knuckle portion is axially substantially aligned with said shank.

12. A tool for operating the bolt mechanism of a cylinder type lock, said lock being provided with a plug having a key slot, said tool comprising an elongated relatively slender metallic rod forming a shank, a first jointed knuckle portion hingedly mounted at an end of said shank by hinge means allowing approximate 90° pivoting of said first jointed knuckle portion from a position aligned with said shank to a postion substantially at a right angle to said shank, at least a second jointed knuckle portion hingedly mounted at an end of said first jointed knuckle portion by hinge means allowing approximate 90° pivoting of said second jointed knuckle portion from a position aligned with said first jointed knuckle portion to a position substantially at a right angle to said first jointed knuckle portion, abutment means preventing pivoting of said jointed knuckle portions in opposite directions, and biasing means constantly urging said jointed knuckle portions to said right angle pivoted position, wherein all of said jointed knuckle portions are hingedly pivotable substantially in a common single plane and said biasing means comprises a spring having an end attached to said shank and a first coil portion disposed around said shank, a second coil portion disposed around said first jointed knuckle portion, said coil portions being interconnected by an integral substantially straight portion, and said second of said coil portions having an integral straight portion attached to said second of said jointed knuckle portions.

13. The tool of claim 12 further comprising a T-handle fastened at the other end of said shank.

14. The tool of claim 12 wherein said hinge means comprises a tongue projecting axially from said end of said shank. a bifurcated end portion at a corresponding end of said jointed knuckle portion, said bifurcated end portion straddling said projecting tongue, a pivot member disposed through aligned transverse bores in said tongue and said bifurcated end portion.

15. The tool of claim 14 wherein said pivot member is a pin.

16. The tool of claim 12 wherein said integral straight portion of the last of said coil portions has an end portion bent over and engaged in a transverse bore in the last of said jointed knuckle portions.

17. The tool of claim 12 wherein said shank has a reduced diameter portion around which said wire coil portion is disposed.

18. The tool of claim 12 wherein each of said knuckle portions has a reduced diameter portion around which each of said wire coil portions is disposed.

19. The tool of claim 12 wherein each of said wire straight portions is disposed in a longitudinal surface groove in each of said knuckle portions when said knuckle portions are axially substantially aligned with said shank.

* * * * *

UNITED STATES PATENT AND TRADEMARK OFFICE

CERTIFICATE OF CORRECTION

PATENT NO. : 4,561,271

DATED : December 31, 1985

INVENTOR(S) : Gerald L. Scharboneau

It is certified that error appears in the above-identified patent and that said Letters Patent are hereby corrected as shown below:

Col. 1, line 41, delete one occurrence of "bolt operating".

Col. 3, line 54, change "o the" to --of the--.

Signed and Sealed this

*First* Day of *April 1986*

[SEAL]

*Attest:*

DONALD J. QUIGG

*Attesting Officer*

*Commissioner of Patents and Trademarks*